United States Patent [19]

Wallin

[11] 4,293,121

[45] Oct. 6, 1981

[54] WINCH ARRANGEMENT

[76] Inventor: Carl O. H. Wallin, Bergliden 20, S-131 42 Nacka, Sweden

[21] Appl. No.: 74,417

[22] Filed: Sep. 11, 1979

[30] Foreign Application Priority Data

Aug. 10, 1979 [SE] Sweden ..... 7906716

[51] Int. Cl.[3] ..... B66D 3/02

[52] U.S. Cl. ..... 254/370; 254/217; 254/222; 254/243; 254/369; 254/376

[58] Field of Search ..... 254/209–222, 254/223–227, 242–260, 326–327, 335–338, 358–359, 363–364, 369–370, 376, 384–385, 352–354, 371; 74/142, 143, 136, 164, 137

[56] References Cited

U.S. PATENT DOCUMENTS

| | | | |
|---|---|---|---|
| 1,062,470 | 5/1913 | Johnston | 254/217 |
| 2,489,022 | 11/1949 | Franks | 254/336 |
| 3,985,342 | 10/1976 | Denman | 254/335 |

*Primary Examiner*—John M. Jillions

*Attorney, Agent, or Firm*—Frishauf, Holtz, Goodman & Woodward

[57] ABSTRACT

A winch arrangement having a feed wheel for feeding a hauling line, such as a line through the winch. The wheel is driven in the feed direction by means of a reciprocatingly movable member, such as a pivotable lever. The lever is pivoted with the aid of the outgoing part of the line, by effecting a pumping movement therewith.

10 Claims, 8 Drawing Figures

WINCH ARRANGEMENT

BACKGROUND OF THE INVENTION

The present invention relates to a winch arrangement having a feed device for feeding a hauling line therethrough, said feed device being driven by a reciprocatingly movable drive means.

When lifting heavy loads or producing high-tension forces manually, for example when hauling in the sheets of a sailing boat, winches or a block-and-tackle are normally used today to amplify the force applied to the hauling line. Known winches, which are operated by means of a crank and lever arrangement, must be operated in the immediate vicinity of the winch. This is a distinct disadvantage in many cases, for example when such winches are used in small sailing boats for hauling in the sheets on the leeside. A block-and-tackle has the advantage over winches in this respect, in so much as a block-and-tackle can be operated by means of the outgoing part of the hauling line at a location which is remote from the actual block. A serious disadvantage with a block-and-tackle, however, is that the transmission ratio is fixed, which means that a relatively long length of line must be hauled in, in order to move the load through only a relatively short distance, even in the case of small loads. This disadvantage is extremely manifest when, for example, using a block-and-tackle for hauling in the main sheets of a sailing boat, when the jib moves from one side of the boat to the other when jibing.

The prime object of the present invention is to provide a winch arrangement which—inter alia aboard sailing boats—can replace both conventional winches and blocks-and-tackles and which can be operated at a location remote from the winch with the aid of the outgoing part of the hauling line, and which enables a small load to be hauled-in or lifted rapidly and provides a considerable amplication of the force applied when so desired, e.g. with an increased load, without requiring any adjustment to the winch itself. By "hauling line" is meant any form of lifting and lowering line or pulling line, such as organic and wire ropes, chains, etc.

SUMMARY OF THE INVENTION

This object is achieved in accordance with the invention by a winch arrangement having a feed device for feeding a hauling line through said arrangement, said feed device being driven by a reciprocatingly movable drive means, and being so constructed that the drive means can be operated with the outgoing part of the hauling line. Preferably, the drive means includes a pivotable lever which is pivoted by the outgoing part of the hauling line and which is arranged to drive the feed device in the feed direction, said lever being arranged to return automatically after each working stroke.

In a preferred embodiment of the invention, the feed device comprises a wheel which is rotatable about the pivot center of the lever and which is arranged to rotate when the lever is swung in the feed direction, said wheel being so constructed that a hauling line located thereon is carried with the wheel upon rotation thereof. The wheel is also provided with a non-return latch which is arranged to be released immediately upon the commencement of each working stroke and to be reactivated upon a completed working stroke at the latest. The non-return latch suitably comprises a pivotable pawl which as the lever returns engages between two adjacent teeth of a ring of teeth arranged on said wheel, said pawl being arranged to be brought out of engagement with said teeth and to be held out of engagement therewith when the lever is again rotated through some degrees in the feed direction, e.g. to permit the load to be lowered.

Preferably, the wheel is entrained upon rotary movement of the lever in the feed direction by means of a friction-coupling arrangement which, inter alia, enables a load attached to the hauling line to be lowered in a controlled manner by means of the outgoing part of the hauling line. Alternatively, the wheel can be entrained by means of a pivotable pawl, the lever being provided with a V-shaped groove in its free end, to permit controlled lowering of a load with the aid of the outgoing part of the hauling line.

In accordance with the invention, the feed device and the lever may be mounted in a holder having the form of a block housing provided with suspension means, enabling the winch to be used as a block-and-tackle arrangement.

Exemplary embodiments of the invention will now be described in more detail with reference to the accompanying schematic drawings. Although the winch arrangement according to the invention can be used with any type of hauling line, e.g. a rope, a belt or a chain, for the sake of simplicity the following description will be made solely with reference to winches using ropes. The winches, however, can readily be adapted to suit other types of hauling lines.

DETAILED DESCRIPTION

Figure 1:
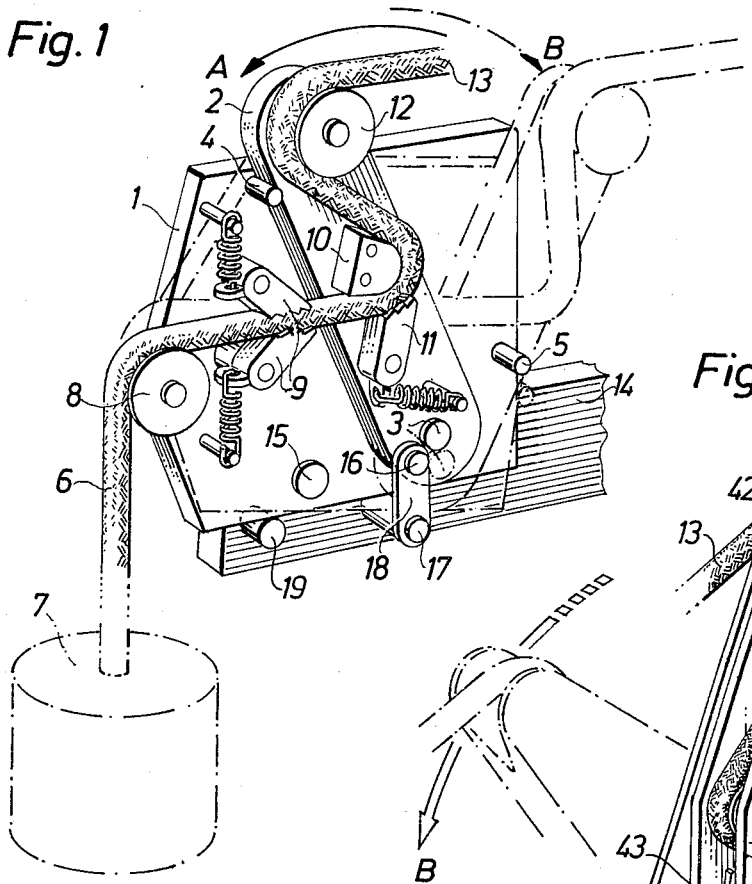
FIG. 1 shows a winch arrangement which illustrates the basic principle of the invention.

The arrangement shown in FIG. 1 comprises a holder plate 1 having a shaft 3 on which a lever 2 is pivotably mounted. The lever 2 can be swung between the position A shown in full lines, in which position said lever rests against a stop means 4, and a position B shown in dash lines, in which latter position the lever rests against a stop means 5. A line 6 having a load 7 attached thereto is passed over a sheave or idler wheel 8 and between two non-return jaws 9 mounted on the plate 1, said jaws, for example, having the form of a jam cleat which permits movement of the line in one direction only. The line 6 also extends between a feed device which is arranged on the lever 2 and which comprises a fixed part 10, and a pivotable clamping means 11 which is biassed towards said fixed part by means of a spring. The line 6 passes from the feed device over a sheave or idler wheel 12 arranged on the free end of said lever, via which sheave 12 the tension force acting in the outgoing part 13 of the line 6 is transferred to the lever 2.

The described winch arrangement has the following mode of operation. When the load 7 is to be lifted, a pulling or tension force is applied to the outgoing part 13 of the line 7. This causes the lever 2 to be swung from the position A to the position B. If the counter force in the line 6 is initially low, which may be the case for example when taking up slack in the anchor line to ease the anchor, the line can be hauled-in with the lever 2 in position B. When a greater force is later required, for example when lifting or releasing the anchor, the lever 2 is returned to position A, which as described hereinafter, can be effected in different ways, whereafter the arm 2 is again moved to position B by pulling in the part 13 of said line. Each time the lever 2 is swung from position A to position B, the line 6 is drawn in through a given distance by means of the feed device 10 and 11, this distance, however, being shorter than the distance through which the part 13 of said line must be moved in order to fully complete a hauling operation. In this way there is obtained a power take-off. Thus, relatively heavy loads can be lifted manually by means of the described small, pumping movements in the line-part 13.

The lever 2 can be returned from position B to position A by means, for example, of a spring. In the illustrated embodiment, however, this return is effected by using the weight of the load 7. To this end, the holder plate 1 is pivotally mounted on a shaft 15 arranged on a beam 14. The lower end of the lever 2 is connected to the beam 14 via a link 18 pivotably mounted on two shafts 16 and 17. In the starting position, the plate 1 rests against a stop member 19. Because of the particular arrangement of the plate 1 and the link 18, as illustrated and described, the plate 1 will be rotated some degrees clockwise when the line-part 13 is drawn in. When the load on said line-part 13 is then relieved, the plate 1 will be swung back by the weight of the load 7, returning the lever 2 to position A through the link 18.

Figure 2:
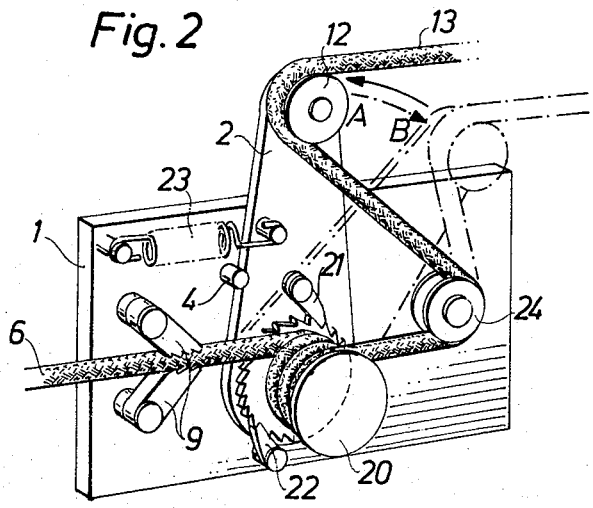
FIG. 2 illustrates an embodiment of a winch arrangement constructed in accordance with the invention.

FIG. 2 illustrates an embodiment of a winch constructed in accordance with the invention and based on the principle illustrated in FIG. 1. Elements which correspond to the FIG. 1 elements are identified by the same reference numerals. The feed device of the FIG. 2 embodiment comprises a winch drum 20 which is mounted for rotation on the pivot shaft of the lever 2. The drum 20 is entrained clockwise with the pivoting movement of the lever 2 by means of a pawl 21. For the purpose of preventing the drum 20 from being rotated counterclockwise when the lever 2 returns from position B to position A, there is arranged on the plate 1 a further pawl 22. The lever 2 is returned to position A by means of a tension spring 23. To ensure that there is sufficient frictional force between the line 6 and the drum 20, the line is wound a number of times around the drum and then passed around a sheave 24, mounted on the plate 1, to the upper sheave 12.

The function of this arrangement is the same as that of the arrangement according to FIG. 1, meaning that, when hauling-in or lifting small weights, the line 6 can be hauled home without any gear change and while holding the lever 2 in position B. When a greater force is required, the line 6 is hauled-in by pumping movements, i.e. alternate drawing and slackening of the line-part 13, to cause the lever 2 to swing between the positions A and B.

With the winch illustrated in FIG. 2, the non-return jaws 9 can be omitted if the drum 20 is replaced by a wheel which is constructed in a manner such that the line is automatically prevented from sliding backwards. Such a wheel, sold under the trade name Peri-Grip wheel, is described in U.S. Pat. No. 3,302,932. With a wheel of this kind, a sufficiently tight grip is obtained by winding the line about one half of a turn about the wheel.

Figure 3:
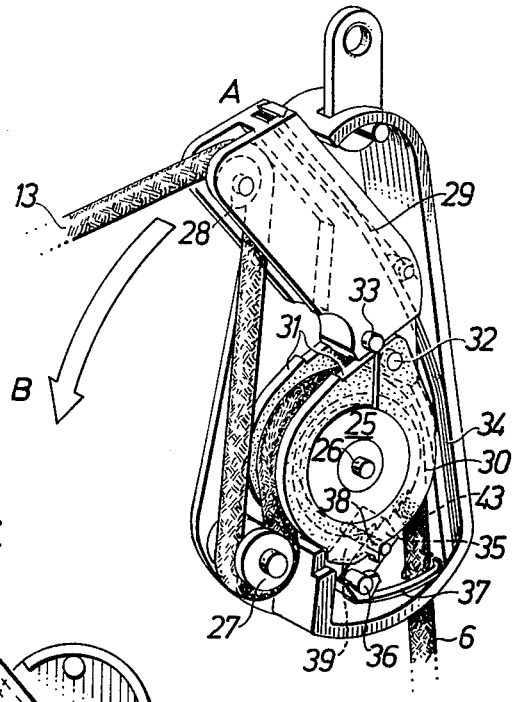
FIG. 3 is a perspective view of a winch block according to the invention, with parts of the casing removed.

FIG. 3 illustrates a preferred embodiment of a winch device constructed in accordance with the invention having the form of a winch block. The winch block comprises a wheel 25 of the Peri-Grip type, which is rotatably mounted on a shaft 26 journalled in a holder having the form of a block housing. In this embodiment, the line 6 extends about half a turn around the wheel 25 and passes, via a sheave 27, to a sheave 28 arranged on the upper end of the lever. The lever is divided into an upper part 29 and a lower part having the form of a friction coupling 30 encircling the wheel 25. The illustrated friction coupling 30 comprises two slotted discs 31, which encircle the wheel 25 with a small clearance therebetween. The upper part of the lever 29 is pivotally connected to the discs or plates 31 through a shaft 32. Mounted on the part 29 is a peg 33 which, when the lever 29 is swung in the direction of the arrow towards position B as a result of a tension force in the line-part 13, exerts a force on the discs or plates 31 in a direction towards the wheel 25 in a manner such as to increase the friction therebetween. As a result, the wheel 25 will be forced to accompany the pivoting movement of the lever 29. The reference 34 identifies a plurality of leaf springs which attempt to return the lever 29 to the starting position.

For the purpose of latching the wheel 25 when the lever 29 returns to its starting position, a releasable pawl 35 is pivotally arranged on a shaft 36. The pawl 35 is biased into engagement with a ratchet arrangement 43 by means of a spring 37. The reference 38 identifies two spring-biased pegs arranged to co-operate with parts 39 of the friction discs 31, said parts 39 acting as camming means.

Figure 4:
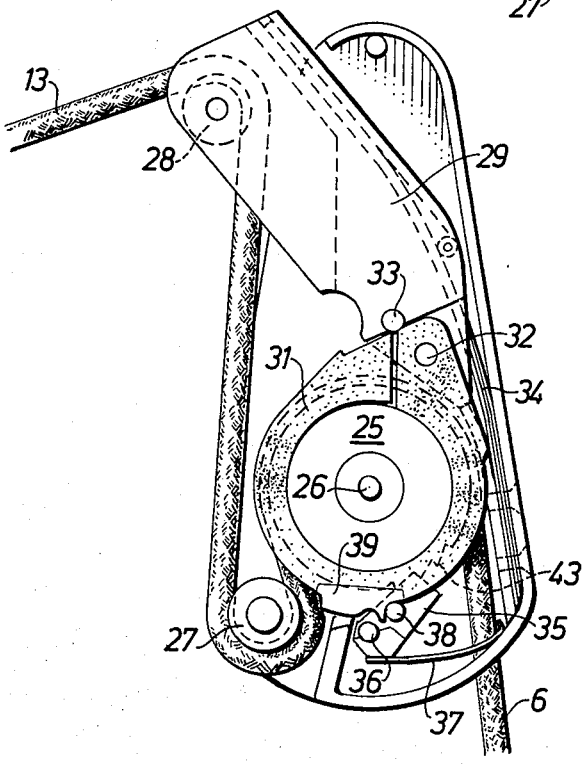
FIGS. 4–6 illustrate the winch block shown in FIG. 3 in different working positions.
Figure 5:
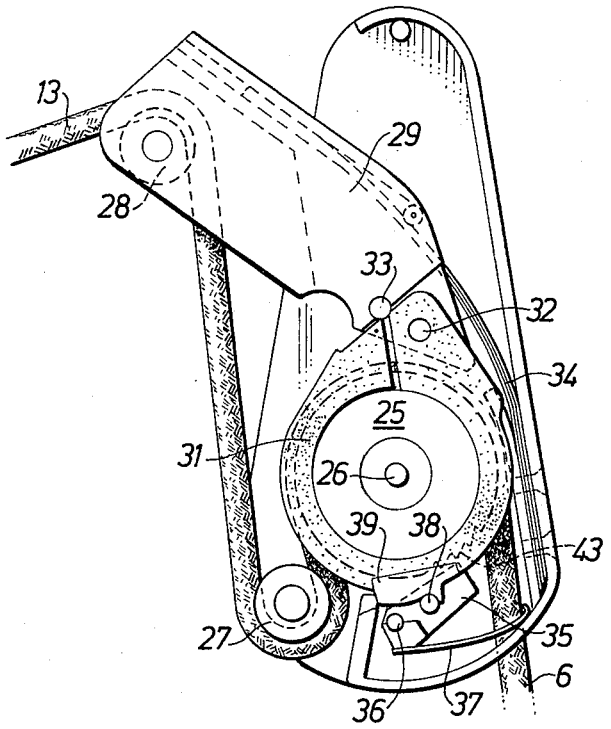
Figure 6:
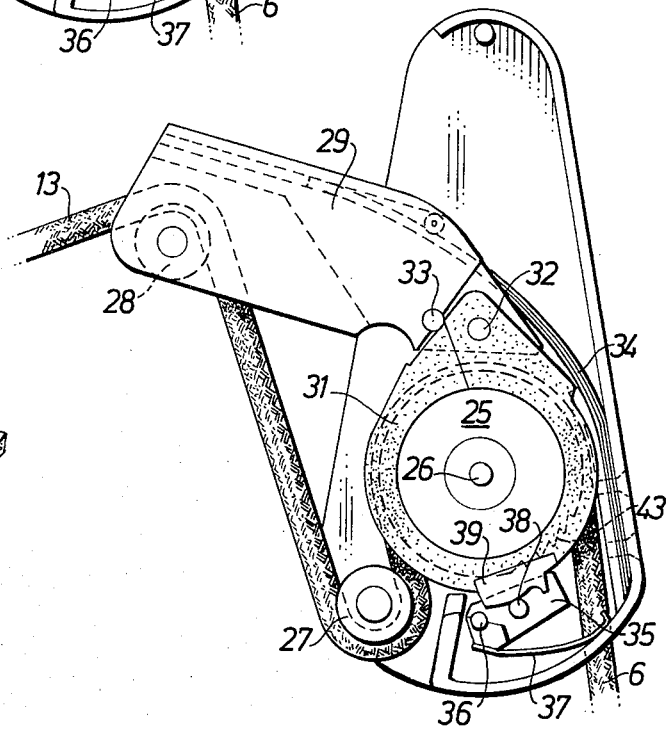

The mode of operation of the winch block illustrated in FIG. 3 will best be seen from FIGS. 4–6. FIG. 4 shows the winch in its starting position, with the pawl 35 in engagement with the ring of teeth 43 on the wheel 25. The peg 38 lies against the periphery of the disc 31. When a tension force is applied to the outgoing line-part 13, the lever 29 will be rotated slightly on its attachment shaft 32, as best seen from FIG. 5, thereby pressing the peg 33 against the periphery of the disc 31. This causes the frictional force acting between the disc 31 and the wheel 25 to be of such magnitude that said wheel 25 is caused to accompany the rotary movement of the lever 29. Subsequent to the lever 29 being swung through some degrees the spring-biased peg 38 will pass out over the outwardly projecting nose of the disc-part 39 serving as said camming means, and be received and latched in a semi-circular recess. In this release position, FIG. 5, the pawl 35 has been swung on its shaft 36 in a manner such as to release engagement with the teeth 43 on the wheel 25. This enables the wheel 25 to rotate clockwise, to lower the load. This lowering movement can be readily controlled with the aid of the outgoing line-part 13, since even when the line is drawn in only very slightly, the wheel 25 is effectively braked as a result of the peg 33 forcing the friction disc 31 against the periphery of the wheel.

Figure 7:
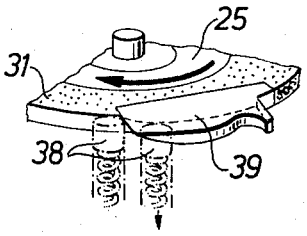
FIG. 7 illustrates a detail in the winch block shown in FIGS. 3–6.

When the line-part 13 is again pulled in, the lever 29 will be further rotated and the wheel 25 entrained with said lever, see FIG. 6. The peg 38 will then pass along the outer edge of the part 39 and reach the end of said part located to the left in FIG. 7 subsequent to further rotation of said lever, although at latest upon the completion of a working stroke of the lever 29. The pawl 35 with the peg 38 is thus urged by the spring 37 into abutment with the periphery of the disc 31, the pawl 35 engaging the teeth 43 on the wheel 25. When the first working stroke has been completed, a small load, or any slack in the line 6, can be simply hauled-in or taken up by pulling directly on the line-part 13 without utilizing any gear-change. When slackening the line-part 13, the leaf springs 34 will return the lever 29 to the starting position, the spring-biased peg 38, as a result of a flank surface of the part 39, being pressed in beneath said part 39, as schematically illustrated in FIG. 7, and passes the periphery of the disc 31 until said peg can re-extend subsequent to passing the outwardly projecting nose. During the whole of this sequence of operation, the pawl 35 is held in engagement with the teeth on the wheel 25. The line-part 13 is slackened for the purpose of returning the lever 29 suitably when the counter weight in the line 6 is of such magnitude as to require the assistance of the gear-change which the winch can afford for hauling-in the load. This is effected, as previously mentioned, by alternately drawing in and slackening the line-part 13 so as to cause the lever 29 to swing between its terminal positions. During each counter-clockwise movement, the wheel 25 is entrained through a given part of a revolution, drawing in the line 6 to a corresponding extent. The transmission ratio is determined by the difference between the distance between the center of the wheel 25 and the point of engagement with the sheave 28 and with the wheel 25, respectively. Because the sheaves 28 and 27 move towards each other there is also obtained a purchase which further reduces the force required to haul-in the load.

Thus, the described winch block enables the line 6 to be hauled-in rapidly without a gear-change for as long as desired, and can then be used as a combined winch and block-and-tackle arrangement with the aid of the line-part 13. Compared with conventional winches, the winch arrangement according to the invention affords the important advantage of being maneuverable from a location remote from the winch and that the transmission ratio can be changed from said location simply by handling the line-part 13 in another way. Compared with conventional block-and-tackle arrangements, the invention affords the advantage that the gear-change is not fixed but that a load can be hauled-in directly, although the gear-change incorporated in the winch arrangement can also be utilized when desired without requiring any adjustments to the winch block itself.

Figure 8:
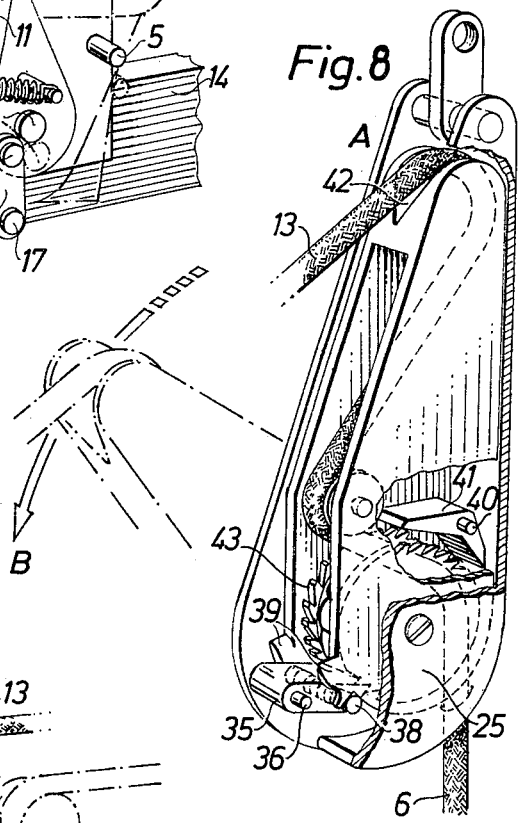
FIG. 8 illustrates an alternative embodiment of a winch block according to the invention, with parts of the casing removed.

FIG. 8 illustrates an alternative embodiment of a winch block constructed in accordance with the invention, the friction-coupling means for causing the wheel 25 to accompany the movement of the lever being replaced by a pawl 41 pivotally mounted on a shaft 40. The pawl 41 is of angular configuration and is so arranged that a leg of said pawl is caused to co-act with a rear wall of the block housing for pivoting said pawl when the lever is returned to the starting position. The other leg of the pawl is then drawn out of engagement with the teeth 43 of the wheel 25. This causes the line 6 to be released in the same manner as that described with reference to FIG. 3, by drawing in the outgoing line-part 13 in a manner such that the peg 38 snaps into the semi-circular recess of the part 39.

In this embodiment, the upper sheave is replaced by a V-shaped groove 42 arranged in the free end surface of the lever, which groove enables the line to be slowed down by friction when lowering the load in said released position, it being relatively simple to control the braking of said line by applying a small counter force on the outgoing line-part 13. Other elements and the mode of operation of the embodiment shown in FIG. 8 are the same as those described with reference to FIG. 3, and hence require no further description.

The aforedescribed embodiments are merely preferred embodiments of the invention, which can be modified within the scope of the claims. Thus, in addition to a pivotable lever a feed wheel or feed drum may be operated by means, for example, of a longitudinally displaceable rack provided with return springs. The rack may either be in direct contact with a ring of teeth on the wheel or drum, or may be in indirect contact via intermediate toothed wheels. Pneumatic or hydraulic power transmissions can also be used. The described radially acting friction coupling can be replaced, for example, by an axially working coupling. The non-return latch shown in the form of a pawl can also be replaced by a friction coupling.

As previously mentioned, a winch constructed in accordance with the invention can also be used with other hauling lines than rope, such as chains and belts, whereby teeth or the like can be used to obtain the same effect as that obtained with wheels of the Peri-Grip type used with the embodiments of FIGS. 3 and 8. Winch arrangements according to the invention are not limited to use on sailing vessels, but can be used in all circumstances where it is desired to amplify the tension forces in hauling lines, particularly when it is desirable to be able to switch between direct pulling and pulling with a gear-change.

What I claim is:

1. A winch arrangement comprising:

a feed device for feeding a hauling line through the winch arrangement, the hauling line having an ingoing part coupled to a load and feeding into the feed device, and an outgoing part leaving the feed device;

drive means for reciprocatingly driving said feed device;

said drive means including a pivotable lever for engaging the outgoing part of the hauling line and arranged to be pivoted from a first position to a second position by means of tension applied to the outgoing part of the hauling line for driving the feed device in the feed direction; and means coupled to said pivotable lever for automatically returning said pivotable lever from its second position back to its first position after each working stroke of said pivotable lever; and said feed device including a non-return latch for selectively preventing return movement of the hauling line through the feed device, and means for automatically releasing said non-return latch immediately upon commencement of each working stroke and for reengaging said non-return latch at the latest when said working stroke is completed.

2. A winch arrangement according to claim 1, wherein said feed device comprises a wheel arranged for rotation about the pivot center of said lever, said wheel being arranged to rotate as a result of the lever pivoting in the feed direction from said first position to said second position, and said wheel including means for entraining a hauling line mounted thereupon with said wheel upon rotation thereof.

3. A winch arrangement according to claim 2, wherein said wheel including a ring of teeth thereon, said non-return latch comprises a pivotable pawl which, upon return of said lever to said first position engages said ring of teeth on said wheel, and means coupled to said pawl for permitting said pawl to be brought out of engagement with said ring of teeth and for maintaining said pawl in a position disengaged from said ring of teeth upon renewed pivoting of the lever through a given number of degrees in the feed direction.

4. A winch arrangement according to claim 3, wherein said pivotable lever comprises camming means which moves with the pivotal rotation of said lever, and wherein said pawl is provided with at least one spring-biased projection arranged to co-operate with a first camming surface of said camming means, said camming means having an engagement position engaging said projection corresponding to a release position of said feed device.

5. A winch arrangement according to claim 4, wherein said projection is movable relative to said pawl to extend varying distances from said pawl, and said camming means comprises a further camming surface for engaging said projection and urging said projection out of engagement with said first camming surface.

6. A winch arrangement according to claim 5, comprising means for resiliently biassing said projection to extend from said pawl to its maximum extent, said second camming surface of said camming means urging said projection toward said pawl, said second camming surface coming out of engagement with said projection when said lever returns to said first position, whereby said projection then extends from said pawl to its maximum extent.

7. A winch arrangement according to claim 2, comprising a friction coupling arrangement between said lever and said wheel for entraining said wheel by rotation of the lever in the feed direction.

8. A winch arrangement according to claim 7, wherein said lever is provided with a peg which, when the lever is pivoted in the feed direction, urges the friction coupling arrangement against the wheel to increase the frictional force therebetween.

9. A winch arrangement according to claim 2, comprising a pawl arranged to cause the wheel to accompany pivoting of the lever in the feed direction, and wherein the lever is provided at its free end with a V-shaped groove for accommodating the outgoing part of the hauling line.

10. A winch arrangement according to claim 1, wherein said feed device and said lever are mounted to a holder in the form of a block housing provided with suspension means, thereby to enable the arrangement to be used as a block-and-tackle arrangement.

* * * * *